US009962570B2

(12) United States Patent
Dallmann

(10) Patent No.: US 9,962,570 B2
(45) Date of Patent: May 8, 2018

(54) TRAMPOLINE GAME SYSTEM

(71) Applicant: Brandon Dallmann, Holland, NE (US)

(72) Inventor: Brandon Dallmann, Holland, NE (US)

( * ) Notice: Subject to any disclaimer, the term of this patent is extended or adjusted under 35 U.S.C. 154(b) by 195 days.

(21) Appl. No.: 14/718,589

(22) Filed: May 21, 2015

(65) Prior Publication Data

US 2015/0335930 A1 Nov. 26, 2015

Related U.S. Application Data

(60) Provisional application No. 62/001,946, filed on May 22, 2014.

(51) Int. Cl.

| | |
|---|---|
| ***A63B 5/11*** | (2006.01) |
| ***A63B 5/16*** | (2006.01) |
| ***A63B 24/00*** | (2006.01) |
| ***A63B 71/00*** | (2006.01) |
| ***A63B 5/00*** | (2006.01) |
| ***A63B 71/06*** | (2006.01) |
| ***A63B 22/00*** | (2006.01) |

(52) U.S. Cl.

CPC ..... *A63B 5/11* (2013.01); *A63B 5/00* (2013.01); *A63B 22/00* (2013.01); *A63B 71/0622* (2013.01); *A63B 71/0686* (2013.01); *A63B 2022/0092* (2013.01); *A63B 2071/0694* (2013.01); *A63B 2209/08* (2013.01); *A63B 2220/805* (2013.01); *A63B 2220/806* (2013.01); *A63B 2220/808* (2013.01); *A63B 2220/833* (2013.01); *A63B 2220/836* (2013.01); *A63B 2225/54* (2013.01)

(58) Field of Classification Search

CPC .... A63B 5/00; A63B 5/08; A63B 5/11; A63B 5/16; A63B 6/00; A63B 2024/0037; A63B 2024/004; A63B 2024/0043; A63B 2024/0046; A63B 24/0084; A63B 21/28; A63B 24/0021; A63B 2024/005; A63F 13/46

See application file for complete search history.

(56) References Cited

U.S. PATENT DOCUMENTS

| | | | | |
|---|---|---|---|---|
| 2,605,557 A * | 8/1952 | Van Deventer | .... | G09B 19/0015 434/250 |
| 7,060,000 B2 * | 6/2006 | Carlson | ..... | A63B 69/0053 434/250 |
| 7,361,104 B2 * | 4/2008 | Levy | ..... | A63B 69/0071 273/317.3 |
| 8,246,521 B2 * | 8/2012 | Alexander | ..... | A63B 5/00 482/142 |
| 8,371,991 B2 * | 2/2013 | Chen | ..... | A63B 5/11 172/135 |
| 2004/0102247 A1 * | 5/2004 | Smoot | ..... | A63F 13/00 463/36 |
| 2005/0043122 A1 * | 2/2005 | Publicover | ..... | A63B 5/11 473/465 |
| 2005/0209053 A1 * | 9/2005 | Knox | ..... | A63B 5/11 482/27 |

(Continued)

*Primary Examiner* — Nyca T Nguyen
(74) *Attorney, Agent, or Firm* — Milligan PC LLO

(57) ABSTRACT

The present invention teaches a trampoline gaming system. According to one example, the present invention includes a system for projecting images onto a trampoline surface and a processing system which awards points based on how players interact with the projected images.

5 Claims, 6 Drawing Sheets

(56) References Cited

U.S. PATENT DOCUMENTS

| | | | | |
|---|---|---|---|---|
| 2006/0135321 | A1* | 6/2006 | Chen | A63B 5/11 482/27 |
| 2011/0034300 | A1* | 2/2011 | Hall | A63B 5/11 482/1 |
| 2012/0019485 | A1* | 1/2012 | Sato | G06F 3/017 345/175 |
| 2013/0257811 | A1* | 10/2013 | Usuda | G06F 3/0425 345/175 |
| 2014/0038678 | A1* | 2/2014 | Chen | A63B 69/0053 463/7 |
| 2014/0327610 | A1* | 11/2014 | Athavale | G06F 3/011 345/156 |
| 2015/0321039 | A1* | 11/2015 | Howe | A63B 5/11 482/8 |

* cited by examiner

TRAMPOLINE GAME SYSTEM

RELATED APPLICATIONS

The present invention claims priority to U.S. Provisional Application No. 62/001,946, filed May 22, 2014.

FIELD OF INVENTION

The present invention is related in general to trampoline game systems and, in particular, to a trampoline game system utilizing electronically-implemented sensors in conjunction with visual targets and feedback.

BACKGROUND OF THE INVENTION

Trampolines are available in wide varieties which are used for popular recreational and sports related activities. They are also utilized for establishing physical fitness via cardiovascular, strength and resistance training, and for improving physical control, coordination, and mental acuity. Generally, trampolines include a bounding surface, a plurality of springs which connect with the bounding surface to the trampoline frame and a plurality of legs that extend from the trampoline frame to support the trampoline frame above the ground.

Examples of previous trampolines include traditional steel frame trampolines which have a nylon sheet supported by springs. Other newer structures include inflatable bounce members having air-bounce replacing springs.

Regardless of the trampoline type, there are very few games which are able to be safely played on a trampoline surface. Further, there are no interactive games incorporating a trampoline which are known.

Based on the foregoing there is a need for a trampoline game system which utilizes electronically-implemented sensors in conjunction with visual targets and feedback. Such a needed system would comprise a processor for executing a command to stop transmission of a current image on a trampoline panel, to change light color, and to transmit the same or new image on a different trampoline panel. Further, the system would use the processor to execute a command for an auditory response to be broadcast to a game player. Such a needed system would also be easy to install and safe for the player. The present invention overcomes prior art shortcomings by accomplishing these critical objectives.

SUMMARY OF THE DISCLOSURE

To minimize the limitations found in the prior art, and to minimize other limitations that will be apparent upon the reading of the specifications, the preferred embodiment of the present invention provides a trampoline game system utilizing electronically implemented sensors in conjunction with visual targets and feedback.

According to a first preferred embodiment, the present invention discloses a trampoline having a top surface and a bottom surface. According to a further aspect, the center portion of the trampoline is horizontal and parallel to the floor. Further, the center portion may be surrounded by a plurality of side panels which are inclined at an angle.

According to a further preferred embodiment, a projection system is located above and/or adjacent to the trampoline for projecting images onto the plurality of panels of the trampoline.

According to a further preferred embodiment, a detection system is located in association with the trampoline. According to a further aspect, the detection system may be located underneath the trampoline panel. According to a further preferred embodiment, the detection system includes an infrared light beam emitter which is mounted to a frame of the trampoline. Optionally, the emitter may be magnetically mounted to the frame. Further, a reflector is positioned on an opposite side of the trampoline panel and mounted to the frame of the trampoline. Optionally, the reflector is magnetically mounted to the frame. The beam of the beam emitter is positioned so that it runs immediately beneath the non-depressed trampoline panel. When the trampoline panel is even slightly depressed, the beam is broken and the sensor transmits a signal to a processor. The processor may then execute a command.

According to a further preferred embodiment, the processor may execute a command to stop transmitting the current image on the current trampoline panel, to change light/color, and to transmit the same or new image on a different trampoline panel. The processor may also execute a command for an auditory response to be broadcast to the game player.

According to a further preferred embodiment, the present invention discloses a system for projecting images onto a trampoline and a detection system located in association with the trampoline. The projection system projects images onto the surface of the trampoline. The system determines when and if the user jumps onto the projected image. During the game, the player jumps to and onto the projected image. If the player does not jump onto the projected image within a defined period of time, the player is penalized and/or the game ends. If the player does jump onto the projected image within the defined period of time, the user is rewarded. The projected image is removed and a new image is projected onto another area of the trampoline. The player then jumps to and onto the newly projected image within a certain variable period of time.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
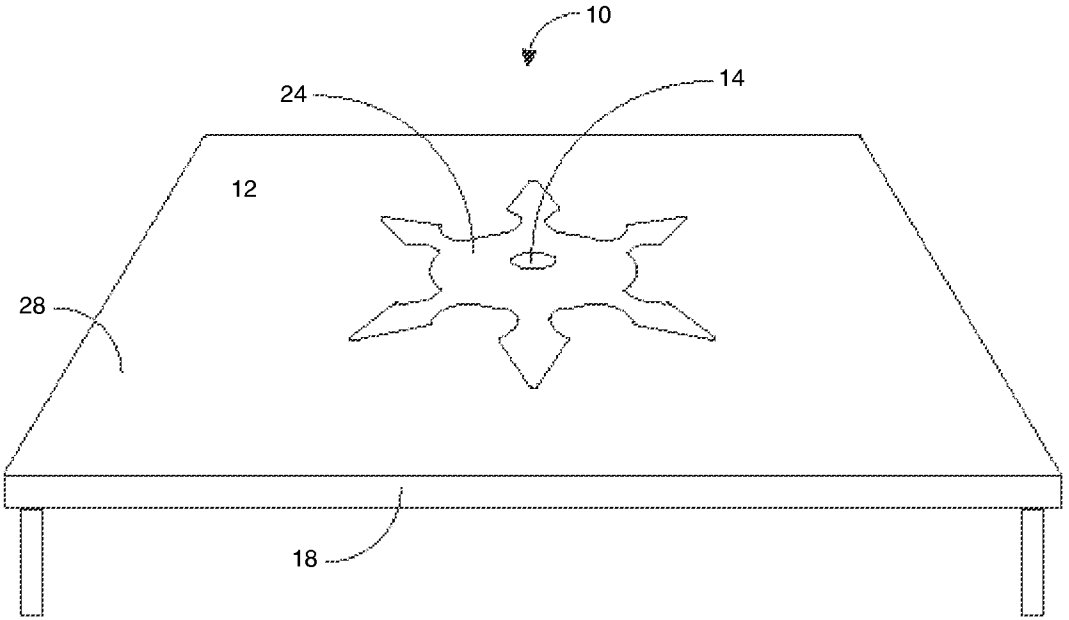
FIG. 1 is a perspective view of a preferred embodiment of a trampoline game system of the present invention.

With reference now to FIG. 1, a perspective view of a preferred embodiment of a trampoline game system will now be discussed. As shown in FIG. 1, the trampoline game system 10 includes a trampoline 28 having a top surface 12 and a bottom surface 16 (see FIG. 2). The trampoline 28 as shown further includes a center portion 14 (also referred to as the trampoline surface or jumping surface) which is horizontal and parallel to the ground. Optionally, the center portion of the trampoline 28 may be surrounded by a plurality of side panels 18. Optionally, the plurality of side panels 18 may be positioned surrounding the center portion 14 of the trampoline 28 which is inclined at an angle.

Figure 2:
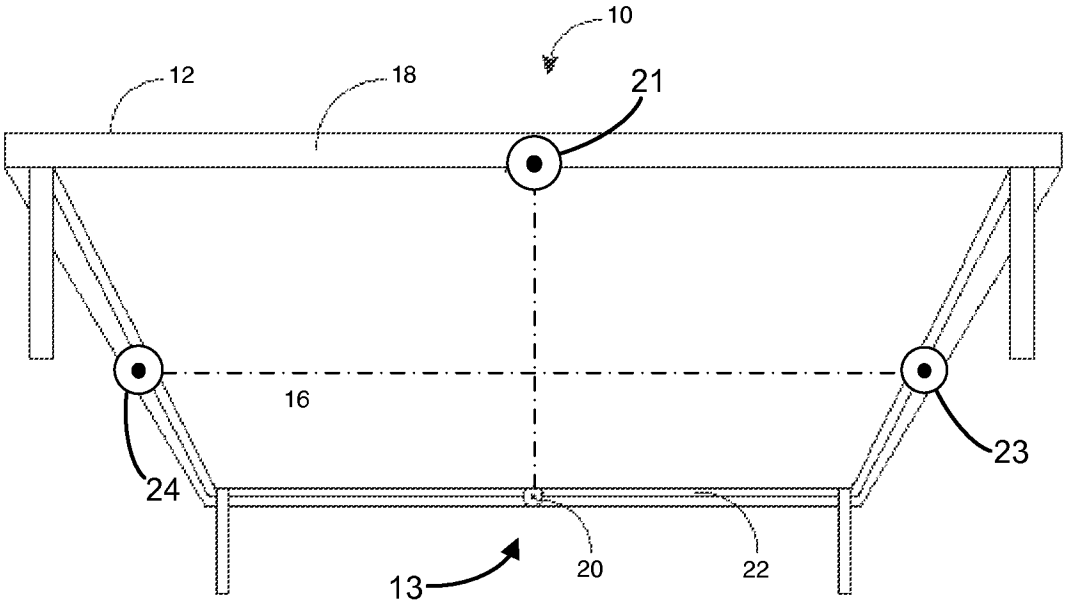
FIG. 2 is a rear perspective view of the preferred embodiment of the trampoline game system of the present invention.

With reference now to FIG. 2, a rear perspective view of the trampoline game system 10 of the present invention will now be discussed. As shown in FIG. 2, an exemplary detection system 13 is located in association with the trampoline 28. According to a preferred embodiment, the detection system determines when and if the user jumps on a particular area of the trampoline surface. The exemplary detection system 13 shown utilizes one or more beam emitters/beam sensors 20, 21, 23 and 25 below the trampoline 28. According to a preferred embodiment, the beam emitters and beam sensors may be combined and contained within a single housing. Alternatively, separate beam emitters and beam sensors may be used at various points beneath the trampoline to detect the location and timing of jumps. According to a further preferred embodiment, the light beam emitters/detectors may preferably emit/detect infrared light beams. Further, the emitters/detectors may be mounted to a frame 22 of the trampoline 28 either mechanically or magnetically. According to a further preferred embodiment, the beam emitter/sensors 20, 21, 23 and 25 are preferably positioned so that they run immediately beneath the non-depressed trampoline 28 to detect the location and timing of jumps.

According to alternative preferred embodiments, the detection system 13 may alternatively use a sound detector, an optical scanner, a vibration wave detector and/or a series of mesh sensors to detect the location or timing of jumps on the surface of the trampoline. Still further, the detection system may alternatively include an RFID ankle bracelet (or the like) and an RFID reader to detect and track the foot movements of player. Still further, an alternative identifying emitter or reflecting element may be incorporated with or attached to the shoes of a player and detected by a matched detector for the particular emitter/reflecting element used.

Regardless of the detection mechanism, the detection system 13 preferably communicates with a central processing unit (CPU) to provide an indication of the location and the timing of jumps.

Figure 3:
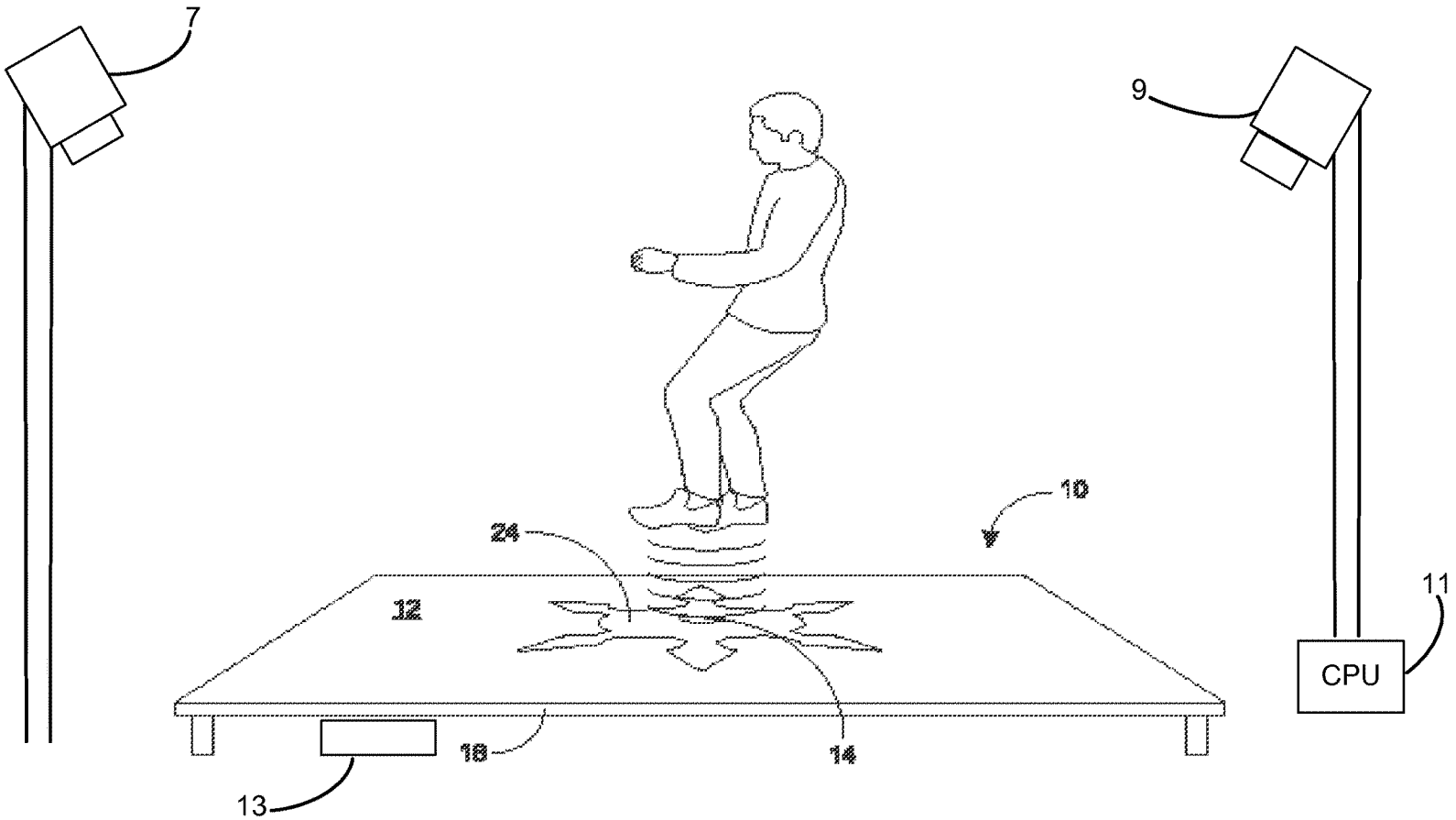
FIG. 3 is a perspective view of a preferred embodiment of the trampoline game system illustrating a user jumping onto the projected image at the center portion of the trampoline.

With reference now to FIG. 3, a perspective view of a trampoline game system in accordance with a preferred embodiment of the present invention will now be discussed. As illustrated in FIG. 3, a trampoline gaming system 10 is shown with a user jumping onto a projected image 24 at the center portion 14 of a trampoline 28. The projection system may include a single or multiple projectors 7, 9 which may be located above and/or adjacent to the trampoline 28. The projectors 7, 9 are preferably controlled by a CPU 11 to project stored images onto the trampoline 28. During one exemplary game, the player's goal is to jump onto a projected image 24 within an allotted time period. If the player does not jump onto the projected image 24 within a defined period of time, the player is penalized and/or the game ends. If the player does jump onto the projected image within the defined period of time, the player is rewarded (e.g., with points, a "level-up", etc.). Further in accordance with an exemplary game, the projected image 24 may then be removed and the CPU may then instruct the projectors 7, 9 to project a new image onto another area of the trampoline 28. Thereafter, the player must then jump to and onto the newly projected image within a certain period of time. The CPU may vary the period of time and size of the images as the game progresses.

Figure 4:
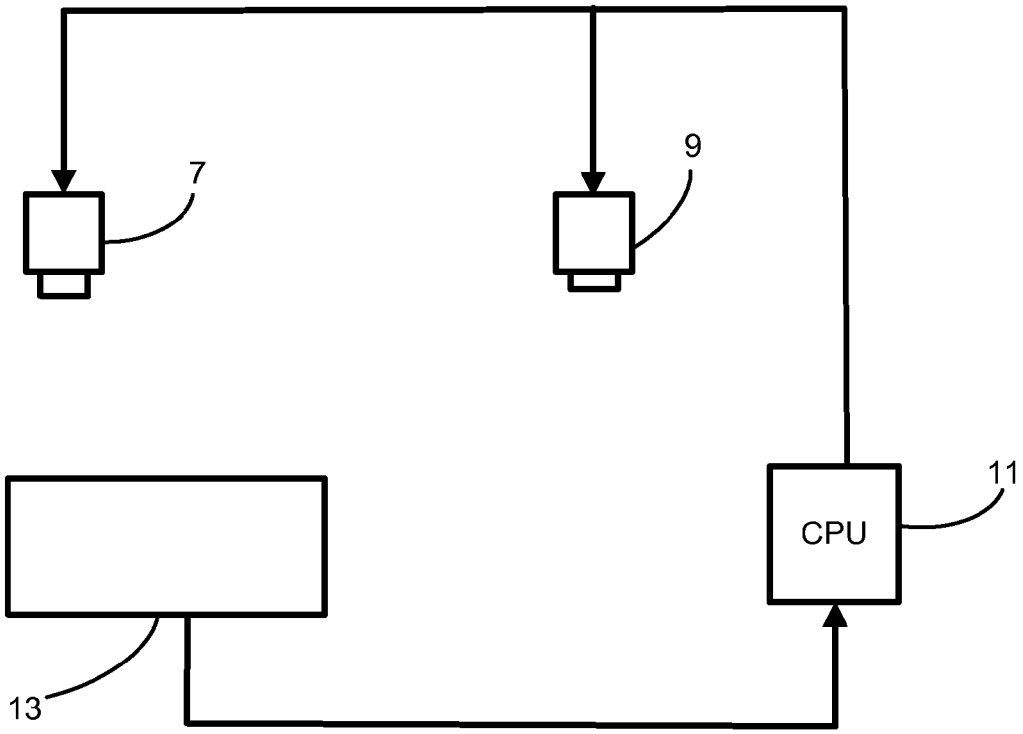
FIG. 4 is a block diagram of the preferred embodiment of FIG. 3.

With reference now to FIG. 4, a block diagram of the preferred embodiment discussed above with respect to FIG. 3 will now be further discussed. As shown in FIG. 4, the detection is system 13 is positioned and configured to detect the location and timing of jumps. As these jumps are detected, the location and timing of the jumps are sent to the CPU for comparison with the timing and location of images projected by the projector(s) 7, 9. Based on this comparison, the CPU 11 determines if a player has or has not successfully jumped onto a projected image within an allotted period of time. The CPU 11 may then assign and track points for individual players depending on factors such as the timing of a jump or the size of an image. Thereafter, the CPU 11 may preferably then execute commands to the projector(s) 7, 9 to stop transmitting the current image on the trampoline 28, to change light/color, and/or to transmit the same or new image. The processor may also execute a command for an auditory response to be broadcast to the game player.

Figure 5:
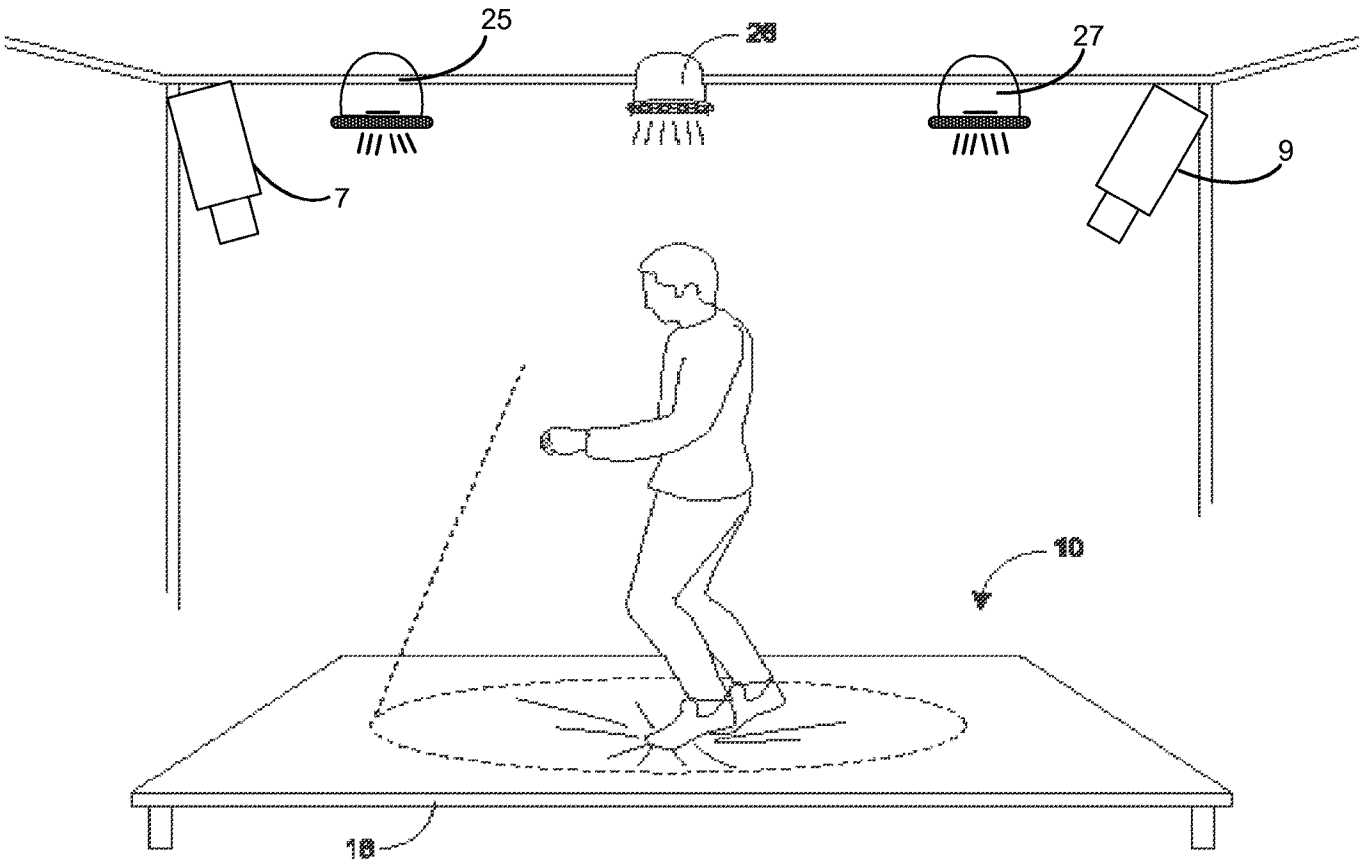
FIG. 5 illustrates an alternative preferred embodiment of the trampoline game system of the present invention.

With reference now to FIG. 5, an alternative detection system will now be discussed. As shown in FIG. 5, the detection system of the present invention may alternatively include one or more detectors 25, 26, 27 which are capable of detecting reflected light from the surface of the trampoline 28 to detect the timing and location of a player's jumps. According to a further preferred embodiment, the detectors may detect the reflected light from the projectors 7, 9. Alternatively, the detectors 25, 26, 27 may detect transmissions from a separate emitter such as from an infrared emitter or a separate projector.

Figure 6:
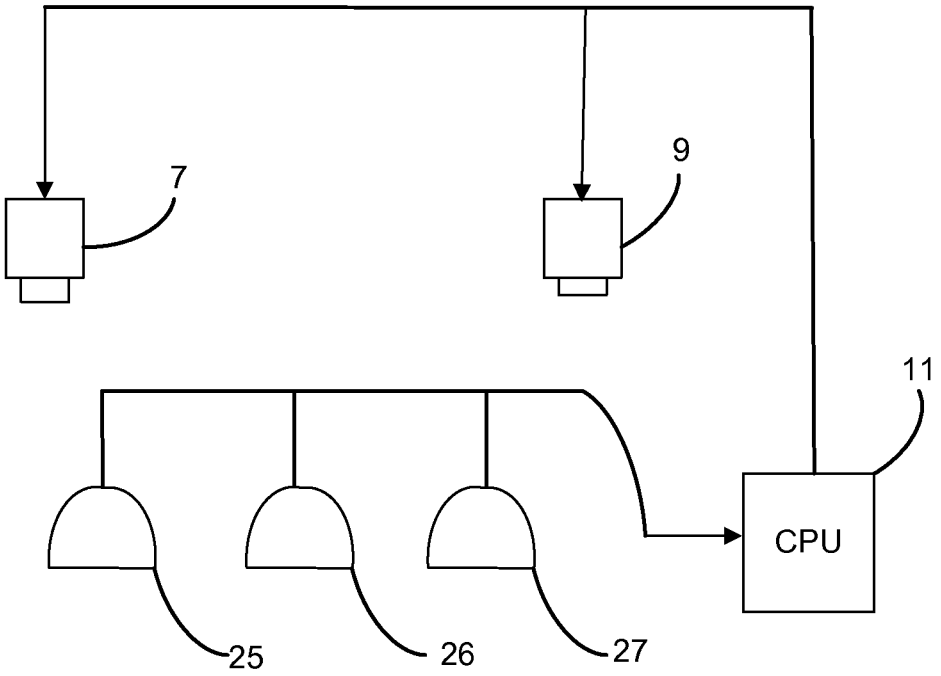
FIG. 6 illustrates a block diagram of the alternative preferred embodiment of FIG. 5.

With reference now to FIG. 6, a block diagram of the preferred embodiment discussed above with respect to FIG. 5 will now be further discussed. As discussed above with respect to FIG. 5, regardless of the emission source, the detectors 25, 26 and 27 are preferably positioned and configured to detect the location and timing of jumps. As these jumps are detected, the location and timing of the jumps are sent to the CPU for comparison with the timing and location of images projected by the projector(s) 7, 9. Based on this comparison, the CPU 11 determines if a player has or has not successfully jumped onto a projected image within an allotted period of time. The CPU 11 may then assign and track points for individual players depending on factors such as the timing of a jump or the size of an image. Thereafter, the CPU 11 may preferably then executed commands to projector(s) 7, 9 to stop transmitting the current image, to change light/color, and/or to transmit the same or new image. The processor may also execute a command for an auditory response to be broadcast to the game player.

Preferably, the various systems of the present invention may communicate using wired or wireless communications or a combination of both.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A system for playing a game on a trampoline comprising:

a trampoline having a jumping surface;

a projection system, wherein the projection system is configured to project images onto the jumping surface based on image data provided by a central processing unit; and a detection system, wherein the detection system is configured to record detection data, wherein the detection data comprises data regarding a location and timing of jumps on the jumping surface;

wherein the projection system is comprised of at least one projector which is connected to a vertically aligned support member;

wherein the central processing unit is configured to receive the detection data and compare the detection data to the image data provided to the projection system to determine whether or not a player has successfully jumped onto a projected image within an allotted period of time;

wherein the projected image is removed and the central processing unit instructs the projector to project a new image onto another area on the jumping surface.

2. The system of claim 1, wherein the central processing unit assigns and tracks points for individual players based on a comparison of detection data and image data.

3. The system of claim 2, wherein the central processing unit is further configured to instruct the projection system to stop projecting an image.

4. The system of claim 3, wherein the central processing unit is further configured to provide an auditory response to the player.

5. The system of claim 1, wherein the detection system further comprises:

an infrared light beam emitter mounted to a frame of the trampoline; and a sensor mounted to the frame of the trampoline.

* * * * *